US010308455B2

(12) United States Patent
Muramoto et al.

(10) Patent No.: US 10,308,455 B2
(45) Date of Patent: Jun. 4, 2019

(54) WORKPIECE CONVEYING APPARATUS

(71) Applicants: Sakura Seiki Co., Ltd., Yao-shi, Osaka (JP); UCHIDA YOKO CO., LTD., Tokyo (JP); Uchida Yoko Global Limited, Kowloon (HK)

(72) Inventors: Ippei Muramoto, Yao (JP); Toshimasa Endo, Tokyo (JP)

(73) Assignees: SAKURA SEIKI CO., LTD., Yao-shi (JP); UCHIDA YOKO CO., LTD., Tokyo (JP); UCHIDA YOKO GLOBAL LIMITED, Kowloon (HK)

( * ) Notice: Subject to any disclaimer, the term of this patent is extended or adjusted under 35 U.S.C. 154(b) by 0 days.

(21) Appl. No.: 15/765,332

(22) PCT Filed: Oct. 7, 2016

(86) PCT No.: PCT/JP2016/079983
§ 371 (c)(1),
(2) Date: Apr. 2, 2018

(87) PCT Pub. No.: WO2017/069006
PCT Pub. Date: Apr. 27, 2017

(65) Prior Publication Data

US 2018/0305148 A1 Oct. 25, 2018

(30) Foreign Application Priority Data

Oct. 20, 2015 (JP) ..... 2015-206079

(51) Int. Cl.

| | |
|---|---|
| ***B65H 3/12*** | (2006.01) |
| ***B65H 3/64*** | (2006.01) |
| ***B65H 3/48*** | (2006.01) |

(52) U.S. Cl.
CPC ..... *B65H 3/128* (2013.01); *B65H 3/12* (2013.01); *B65H 3/48* (2013.01); *B65H 3/64* (2013.01);
(Continued)

(58) Field of Classification Search
CPC ..... B65H 3/128; B65H 3/124; B65H 3/04; B65H 7/18; B65H 2406/3124; B65H 2406/323; B65H 2406/351
(Continued)

(56) References Cited

U.S. PATENT DOCUMENTS 3,260,520 A * 7/1966 Sugden ..... B65H 3/124 271/104
2007/0216087 A1 9/2007 Matsudaira
(Continued)

FOREIGN PATENT DOCUMENTS

JP S59-26455 U 2/1984
JP 2007-246207 A 9/2007
(Continued)

OTHER PUBLICATIONS

Machine translation of JP 2011-042470 A, dated Mar. 3, 2011 , Canon Inc.*

(Continued)

*Primary Examiner* — David H Bollinger
(74) *Attorney, Agent, or Firm* — Kratz, Quintos & Hanson, LLP

(57) ABSTRACT

A guide member (14) has an upper surface assisting conveyance of workpieces (44) mounted on a table (12) and is arranged downstream of the table (12) in a workpiece conveyance direction. A belt drive mechanism (16) has pulleys (26*a* to 26*d*, 28*a* to 28*b*), and endless belts (32*a* to 32*d*) wound around these pulleys, and is arranged above the table (12) and the guide member (14) so as to stride over the
(Continued)

table (12) and the guide member (14). A first opening portion is formed on a bottom portion of the belt drive mechanism (16) to generate an upward suction force. A second opening portion is formed on the upper surface of the guide member (14) to generate a downward suction force. A magnitude of the suction force generated in the first opening portion exceeds a magnitude of the suction force generated in the second opening portion.

6 Claims, 5 Drawing Sheets

(52) U.S. Cl.
CPC ..... *B65H 2301/44336* (2013.01); *B65H 2301/44514* (2013.01); *B65H 2301/44735* (2013.01); *B65H 2404/264* (2013.01); *B65H 2406/31* (2013.01); *B65H 2406/323* (2013.01)

(58) Field of Classification Search
USPC ..... 271/11, 10.03, 98, 94, 104
See application file for complete search history.

(56) References Cited

U.S. PATENT DOCUMENTS

| | | | | |
|---|---|---|---|---|
| 2012/0113488 | A1 | 5/2012 | Machida | |
| 2016/0122144 | A1* | 5/2016 | Fukumoto ..... | B65H 1/12 271/12 |

FOREIGN PATENT DOCUMENTS

| | | | |
|---|---|---|---|
| JP | 2011-042470 | A | 3/2011 |
| JP | 2012-111565 | A | 6/2012 |

OTHER PUBLICATIONS

International Search Report for International Application No. PCT/JP2016/079983 dated Nov. 29, 2016 (2 Sheets).

* cited by examiner

WORKPIECE CONVEYING APPARATUS

TECHNICAL FIELD

The present invention relates to a workpiece conveying apparatus, and particularly, relates to a workpiece conveying apparatus for conveying stacked sheet-form workpieces one by one.

BACKGROUND ART

An example of this type of apparatus is disclosed in Patent Literature 1. According to the background art, a first suction means and a second suction means are arranged on a conveyance path, and generate suction forces in the opposite direction to each other. A paper conveyed out from a paper feeding portion is suctioned by the first suction means, and a paper fed in an overlapping manner on the paper is suctioned by the second suction means. The paper suctioned by the first suction means is supplied to a photoreceptor after passing through the conveyance path. On the other hand, the paper suctioned by the second suction means is discharged into a stacking box after passing through a multi-feeding path branched off from the conveyance path.

CITATION LIST

Patent Literature

[PTL 1] Japanese Unexamined Patent Application Publication No. 2007-246207

SUMMARY OF INVENTION

Technical Problem

However, in the background art, there is a problem in that in order to reuse a paper (sheet-form workpiece) separated by a suction of the second suction means, it is necessary to remount the paper to the paper feeding portion, increasing an operator's load during operation.

Therefore, a primary object of the present invention is to provide a workpiece conveying apparatus capable of conveying sheet-form workpieces one by one without receiving assistance from an operator during operation.

Solution to Problem

A workpiece conveying apparatus (10: reference numeral corresponding to an embodiment. The same applies hereinafter) according to the present invention includes: a table (12) on which sheet-form workpieces (44) are mounted in a stacked state, a guide member (14) which has an upper surface (14*tp*) assisting a conveyance of the workpieces and which is arranged downstream of the table (12) in a workpiece conveyance direction; and a belt drive mechanism (16) which has a plurality of pulleys (26*a* to 26*d*, 28*a* to 28*d*) each extending in a direction orthogonal to both the workpiece conveyance direction and an up-and-down direction and an endless belt (32*a* to 32*d*) wound around the plurality of pulleys, which is arranged above the table and the guide member so as to stride over the table and the guide member, in which a first opening portion (OP1) which generates an upward first suction force is formed on a bottom portion of the belt drive mechanism, a second opening portion (OP2) which generates a downward second suction force is formed on the upper surface of the guide member, and a magnitude of the first suction force exceeds a magnitude of the second suction force.

The belt drive mechanism is arranged above the table and the guide member so as to stride over the table and the guide member. Furthermore, the upward first suction force is generated in the first opening portion formed on the bottom portion of the belt drive mechanism.

Therefore, a workpiece mounted on the table adheres to the bottom portion of the belt drive mechanism at an upstream end of the first opening portion, and conveyed downstream by the endless belt. When the adhering workpiece reaches a downstream end of the first opening portion, the workpiece is separated from the belt drive mechanism and conveyed along the upper surface of the guide member.

In view of the foregoing, the second opening portion which generates the downward second suction force is formed on the upper surface of the guide member. Furthermore, the magnitude of the second suction force falls below the magnitude of the first suction force.

Therefore, if two workpieces are multi-fed, although a first workpiece reaches the downstream end of the first opening portion and is conveyed further downstream on the upper surface of the guide member, a second workpiece adheres to the guide member by the second suction force generated in the second opening portion.

The second workpiece adhering to the guide member adheres to the bottom portion of the belt drive mechanism at a timing for canceling the multi-feeding with the first workpiece, and is conveyed to the downstream by the endless belt. As a result, it is possible to convey the workpieces one by one without receiving assistance from an operator during operation.

It is preferable that the downstream end of the second opening portion is arranged upstream of the downstream end of the first opening portion. As a result, it is possible to ensure that the multi-fed second workpiece adheres to the guide member.

It is preferable that a distance from the downstream end of the second opening portion to the upstream end of the first opening portion is shorter than a length from the leading end to the tailing end of the workpiece.

If two workpieces are multi-fed, the second workpiece adheres to the guide member at a position displaced toward the downstream from an original position. In view of the foregoing, a distance from the downstream end of the second opening portion to the upstream end of the first opening portion is set to be shorter than the length from the leading end to the tailing end of the workpiece. As a result, it is possible to alleviate a concern that a third workpiece adheres to the endless belt in a state where the second workpiece adheres to the guide member.

It is preferable that the belt drive mechanism further includes a motor (38*m*) which rotates the plurality of pulleys at a peripheral velocity lower than a peripheral velocity of a conveyance roller (46) arranged downstream of the guide member.

The workpiece released from the endless belt at the downstream end within the workpiece adhering range is conveyed on the upper surface of the guide member and is further conveyed downstream by the conveyance roller. In view of the foregoing, the plurality of pulleys rotate at a peripheral velocity lower than the peripheral velocity of the conveyance roller. As a result, if two workpieces are multi-fed, it is possible to ensure that the first workpiece and the second workpiece are separated.

It is preferable that the motor intermittently rotates the plurality of pulleys, based on a positional relationship between the workpiece conveyed by the belt drive mechanism and the conveyance roller. By intermittently rotating the plurality of pulleys, a workpiece conveyance operation is stabilized.

Advantageous Effects of Invention

According to the present invention, it is possible to convey the workpieces one by one without receiving assistance from an operator during operation.

The above-described object, other objects, features and advantages of the present invention will become more apparent from the following detailed description of the embodiment when taken in conjunction with the accompanying drawings.

DESCRIPTION OF EMBODIMENTS

Figure 1:
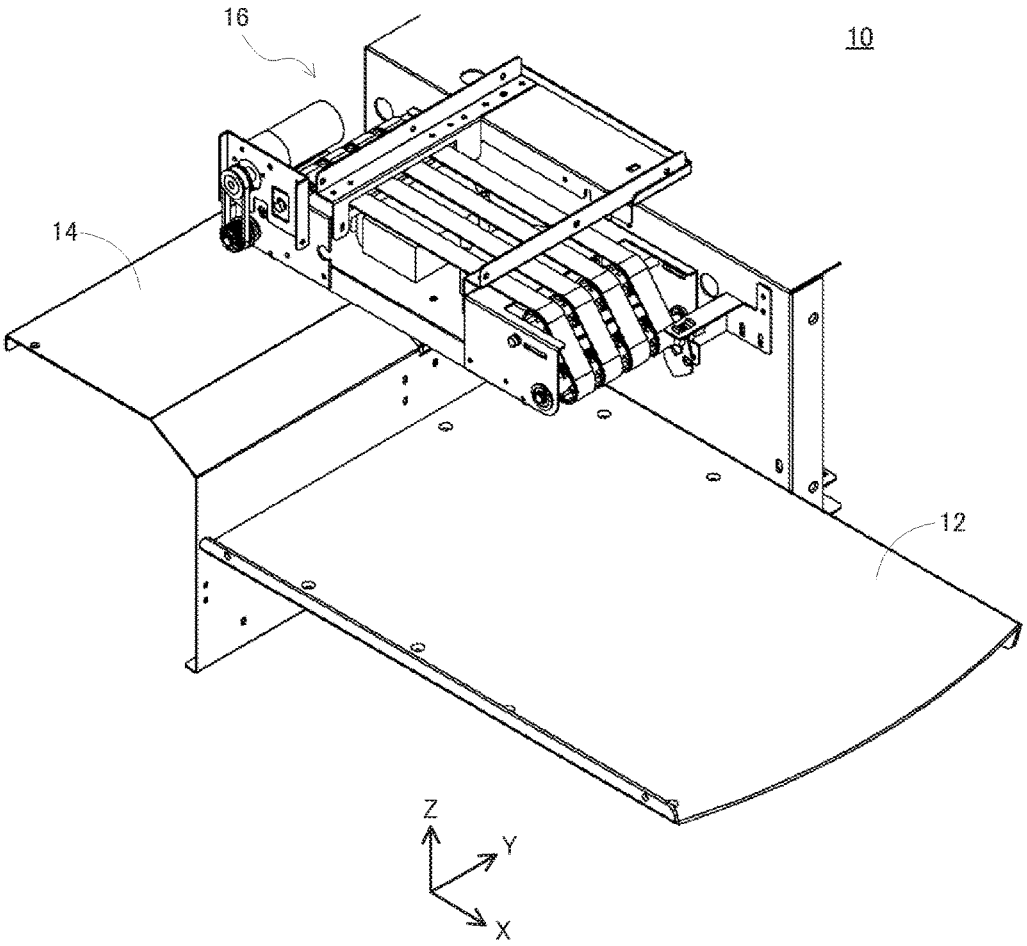
FIG. 1 is a perspective view illustrating a state obtained when a workpiece conveying apparatus of the present embodiment is viewed obliquely from above.

With reference to FIG. 1, a workpiece conveying apparatus 10 of the present embodiment is configured by a table 12, a guide member 14, and a belt drive mechanism 16. The table 12 is arranged upstream in a work conveyance direction and the guide member 14 is arranged downstream in the work conveyance direction. Furthermore, the belt drive mechanism 16 is arranged above the table 12 and the guide member 14 so as to stride over the table 12 and the guide member 14.

On the table 12, sheet-form workpieces 44, 44, . . . like paper (see FIG. 6) is mounted in a stacked state. A main surface of the mounted workpiece 44 is formed in a rectangular shape, and a longer side of the rectangular shape extends along a sheet conveying direction. In the present embodiment, an X axis, a Y axis, and a Z axis are assigned to a length direction, a width direction, and a thickness direction of the thus mounted workpiece 44, respectively.

It is noted that a positive side in an X-axis direction corresponds to the upstream in the workpiece conveyance direction and a negative side in the X-axis direction corresponds to the downstream in the workpiece conveyance direction. Furthermore, the positive side in a Z-axis direction corresponds to an upward direction and a negative side in the Z-axis direction corresponds to a downward direction.

Figure 2:
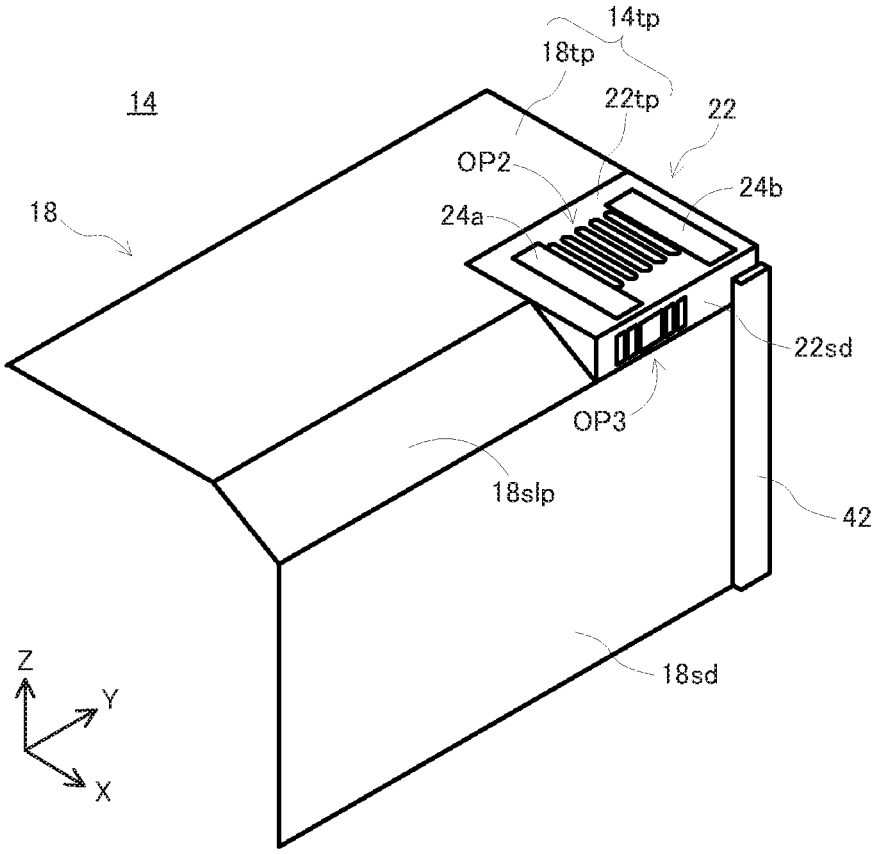
FIG. 2 is a perspective view illustrating a state obtained when a guide member included in the workpiece conveying apparatus is viewed obliquely from above.
Figure 4:
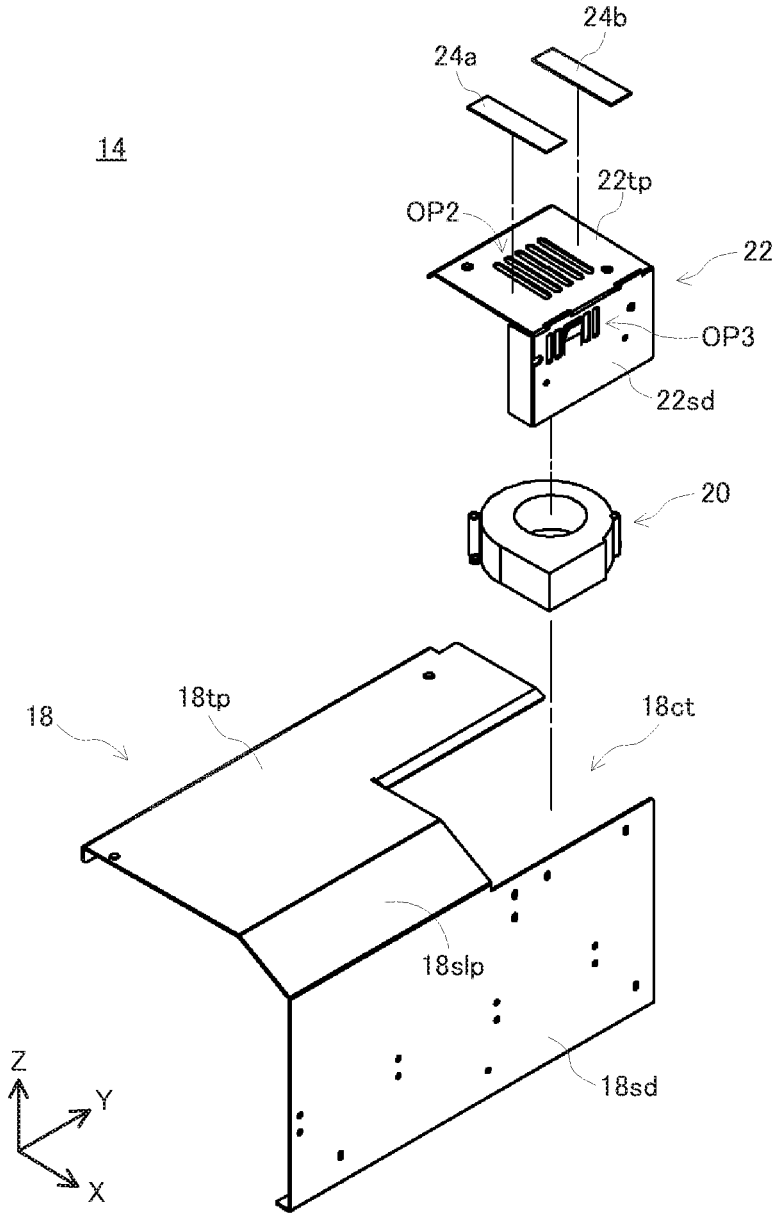
FIG. 4 is an exploded view illustrating the guide member illustrated in FIG. 2 in an exploded state.

With reference to FIG. 2 and FIG. 4, the guide member 14 includes a base plate 18, a blower stay 22 attached to the base plate 18, and a blower 20 held by the blower stay 22.

The base plate 18 has an upper surface 18*tp* which assists conveyance of the workpiece 44 by the belt drive mechanism 16, a side surface (wall surface) 18*sd* which regulates a positional displacement of the workpieces 44, 44, . . . stacked on the table 12, and further includes a slope 18*slp* which is provided at a position connecting the upper surface 18*tp* and the side surface 18*sd* to cancel a deflection of the workpiece 44 during conveyance.

The base plate 18 is also formed with a cutout portion 18*ct* which partially cuts out the upper surface 18*tp*, the slope 18*slp*, and the side surface 18*sd* at an end portion at the positive side in a Y-axis direction. The blower 20 and the blower stay 22 holding the blower 20 are fit into this cutout portion 18*ct*.

The blower stay 22 also has an upper surface 22*tp* and a side surface 22*sd*. In a state of being fit into the cutout portion 18*ct*, the upper surface 22*tp* is flush with the upper surface 18*tp* and the side surface 22*sd* is substantially flush with the side surface 18*sd*. An upper surface 14*tp* of the guide member 14 (see FIG. 2) is formed by the upper surfaces 22*tp* and 18*tp*.

A second opening portion OP2 is formed on the upper surface 22*tp* and a third opening portion OP3 is formed on the side surface 22*sd*. Particularly, the second opening portion OP2 is formed of a plurality of through holes which extend linearly in the X-axis direction and are arrayed in the Y-axis direction. The blower 20 generates a downward suction force in the second opening portion OP2 to ensure that the workpiece 44 being conveyed adheres to the upper surface 22*tp*. A part of air suctioned through the second opening portion OP2 is exhausted from the third opening portion OP3. The workpieces 44, 44, . . . stacked on the table 12 are separated by the air exhausted from the third opening portion OP3.

Strip-like friction materials (urethane plates) 24*a* and 24*b* are also affixed to the upper surface 22*tp*. The friction material 24*a* extends along the X axis on a negative-side position in the Y-axis direction relative to the second opening portion OP22, and the friction material 24*b* extends along the X axis on a positive-side position in the Y-axis direction relative to the second opening portion OP22. The positional displacement of the workpiece 44 adhering to the upper surface 22*tp* is suppressed by the friction materials 24*a* and 24*b* affixed in this manner.

It is noted that although not illustrated in FIG. 4, a workpiece alignment 42 is affixed on the side surface 18*sd*. The workpiece alignment 42 is a member which aligns the workpieces 44, 44, . . . stacked on the table 12 and extends a positive-side end portion in the Y-axis direction into the Z-axis direction.

Figure 3:
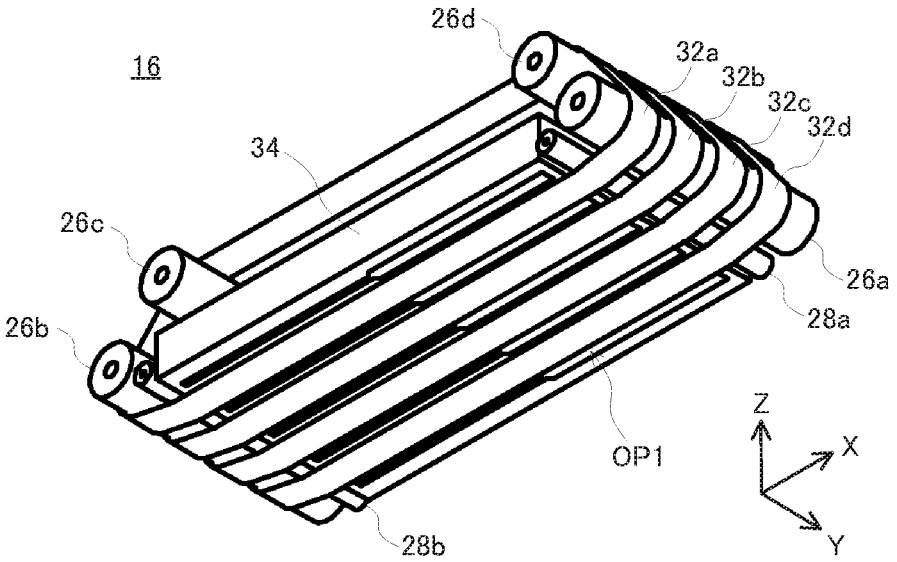
FIG. 3 is a perspective view illustrating a state obtained when a belt drive mechanism included in the workpiece conveying apparatus is viewed from obliquely below.
Figure 5:
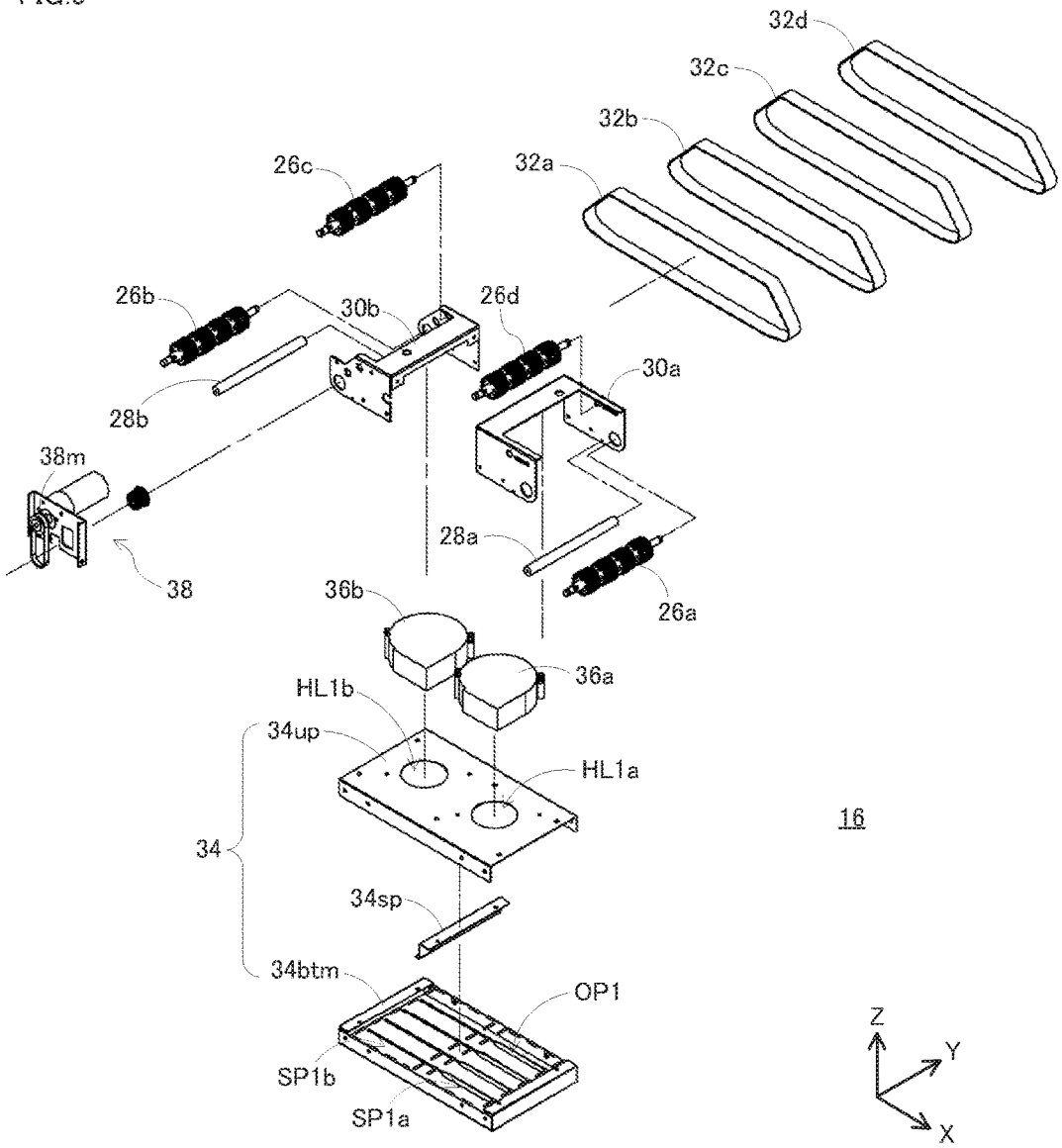
FIG. 5 is an exploded view illustrating the belt drive mechanism illustrated in FIG. 3 in an exploded state.

With reference to FIG. 3 and FIG. 5, the belt drive mechanism 16 includes pulley holders 30*a* and 30*b* arranged with a spacing therebetween in the X-axis direction. Specifically, the pulley holder 30*a* is arranged on the positive side in the X-axis direction and the pulley holder 30*b* is arranged on the negative side in the X-axis direction. However, an arrangement in each of the Y-axis direction and the Z-axis direction matches between the pulley holders 30*a* and 30*b*.

Large diameter pulleys 26*a*, 26*d*, and a small diameter pulley 28*a* are held by the pulley holder 30*a*, and the large diameter pulleys 26*b*, 26*c* and the small diameter pulley 28*b* are held by the pulley holder 30*b*.

Each rotational axis of the held large diameter pulleys 26*a* to 26*d* and the small diameter pulleys 28*a* and 28*b* extends along the Y axis. Furthermore, an arrangement in the Z-axis direction (height direction) matches between the large diameter pulleys 26*a* and 26*b*, matches between the large diameter pulleys 26*c* and 26*d*, and matches between the small diameter pulleys 28*a* and 28*b*. However, the large diameter pulleys 26*c* and 26*d* are arranged at a higher position than the large diameter pulleys 26*a* and 26*b*, and the small diameter pulleys 28*a* and 28*b* are arranged at a slightly lower position than the large diameter pulleys 26*a* and 26*b*.

A case 34 is configured by an upper-side case member 34*up* having a ceiling surface on which through holes HL1*a* and HL1*b* are formed, a bottom-side case member 34*btm* having a bottom surface on which the first opening portion OP1 is formed, and a partition plate 34*sp* housed in the bottom-side case member 34*btm*.

More specifically, the through holes HL1*a* and HL1*b* are common in size and arrayed in the X-axis direction. The through hole HL1*a* is arranged on the positive side in the X-axis direction and the through hole HL1*b* is arranged on the negative side in the X-axis direction.

The partition plate 34*sp* is arranged on the bottom-side case member 34*btm* so as to extend, along the Y axis, between the through holes HL1*a* and HL1*b*. As a result, an inner space of the case 34 is partitioned into a space SP1*a* beneath the through hole HL1*a* and a space SP1*b* beneath the through hole HL1*b*.

The first opening portion OP1 includes a plurality of through holes linearly extending in the X-axis direction and arrayed in the Y-axis direction. A width of each through hole is larger in the upstream (the space SP1*a* side) of the partition plate 34*sp* and narrower in the downstream (the space SP1*b* side) of the partition plate 34*sp*.

A blower 36*a* is arranged on the ceiling surface of the upper-side case member 36*up* so as to cover the through hole HL1*a*. Furthermore, a blower 36*b* has the same size and capability as the blower 36*a* and is arranged on the ceiling surface of the upper-side case member 34*up* so as to cover the through hole HL1*b*. The blowers 36*a* and 36*b* arranged in such a way generate the upward suction force in the first opening portion OP1.

Figure 6:
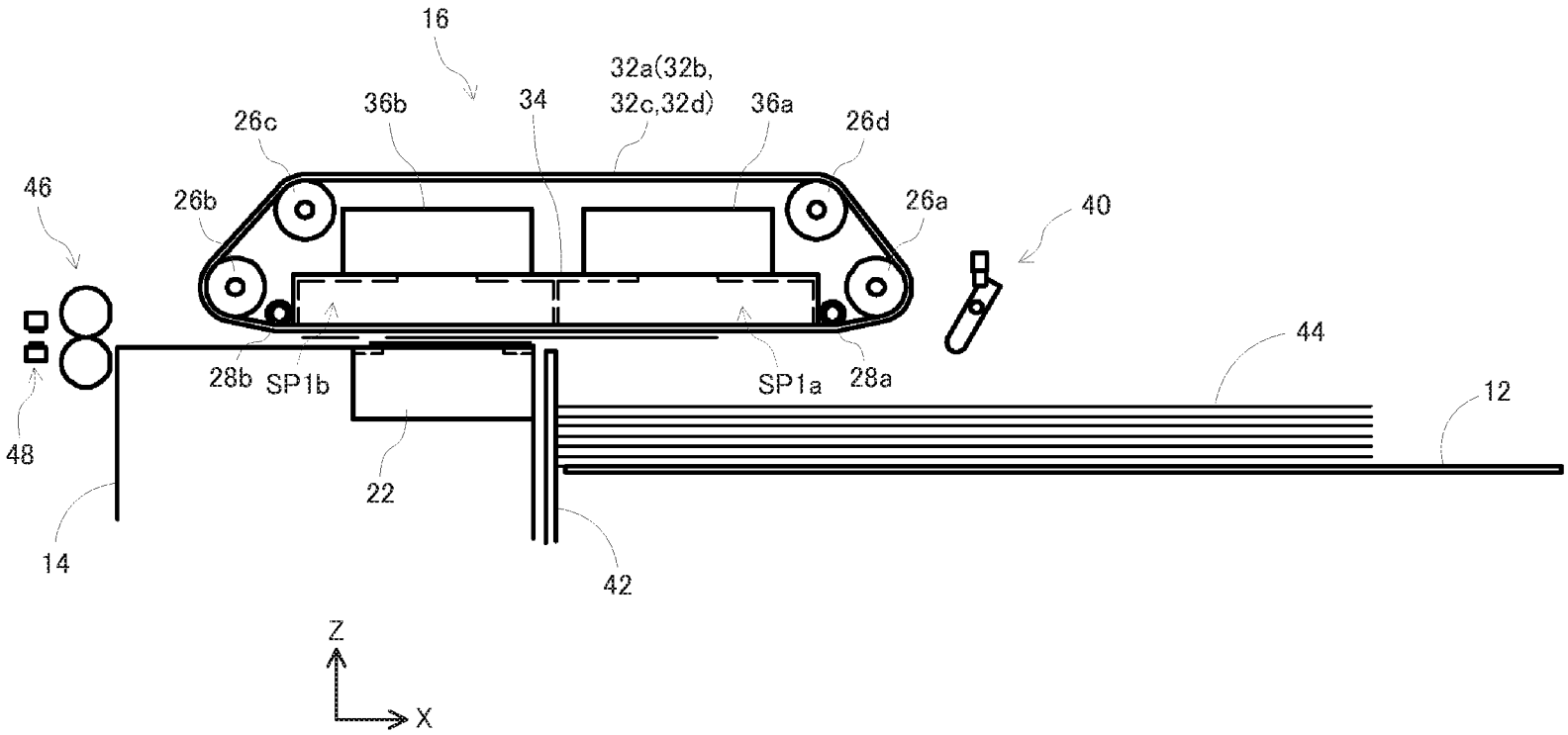
FIG. 6 is a sectional view illustrating a certain section of the workpiece conveying apparatus.

The upward suction force generated in the first opening portion OP1 exceeds the downward suction force generated in the second opening portion OP2. Furthermore, as illustrated in FIG. 6, the downstream end of the first opening portion OP1 is arranged downstream of the second opening portion OP2. More precisely, the downstream end of the first opening portion OP1 is arranged downstream of the both downstream end and upstream end of the second opening portion OP2. Furthermore, a distance from the downstream end of the second opening portion OP2 to the upstream end of the first opening portion OP1 is less than a length from a leading end to a tailing end of the workpiece 44.

Returning to FIG. 5, a height size of the case 34 is equal to or less than half a height size of each of the pulley holders 30*a* and 30*b*, and a height size of each of the blowers 36*a* and 36*b* is also equal to or less than half a height size of each of the pulley holders 30*a* and 30*b*. Furthermore, a width of the case 34 is slightly less than each width of the pulley holders 30*a* and 30*b*, and a length of the case 34 is slightly less than a spacing between the small diameter pulleys 28*a* and 28*b*.

The case 34, and the blowers 36*a* and 36*b* are arranged between the pulley holders 30*a* and 30*b* so that a height position of the bottom surface of the bottom-side case member 34*btm* matches a height position of the lower end of the pulley holders 30*a* and 30*b*. As a result, the case 34 is interposed between the small diameter pulleys 28*a* and 28*b*, and further interposed between the large diameter pulleys 26*a* and 26*b*. Furthermore, the height position of the upper surface of each of the blowers 36*a* and 36*b* is lower than the height position of the upper surface of the pulley holders 30*a* and 30*b*.

The endless belts 32*a* to 32*d* are wound around the large diameter pulleys 26*a* to 26*d* and the small diameter pulleys 28*a* and 28*b*. The wound endless belts 32*a* to 32*d* are arrayed in an order of "32*a*", "32*b*", "32*c*", and "32*d*" as viewed from the negative side to the positive side in the Y-axis direction. The case 34, and the blowers 36*a* and 36*b* are housed inside the endless belts 32*a* to 32*d* wound in this manner.

A motor unit 38 having a drive motor 38*m* is also attached to the pulley holder 30*b*. The drive motor 38*m* rotates the large diameter pulley 26*b* in a clockwise direction as viewed from the negative side in the Y-axis direction. Alongtherewith, the endless belts 32*a* to 32*d* rotate in the same direction.

With reference to FIG. 6, a distance from the workpiece 44 of a top layer mounted on the table 12 to the bottom surface of the belt drive mechanism 16 is detected by a sensor 40 provided in a proximity of the large diameter pulley 26*a*. The table 12 moves up and down so that a detected distance indicates a designated value. That is, the table 12 gradually ascends each time the workpiece 44 is conveyed out.

The upward suction force is generated in the first opening portion OP1, and thus, the workpiece 44 of the top layer adheres to the endless belts 32*a* to 32*d* and is conveyed downstream. Furthermore, the upward suction force generated in the first opening portion OP1 exceeds the downward suction force generated in the second opening portion OP2, and thus, the workpiece 44 adhering to the endless belts 32*a* to 32*d* reaches the small diameter pulley 28*b* without contacting with the upper surface 14*tp* of the guide member 14, and then, is conveyed downstream on the upper surface 14*tp* of the guide member 14.

A conveyance roller 46 is provided at a position downstream of the belt drive mechanism 16. When the leading end of the workpiece 44 reaches the conveyance roller 46, the workpiece 44 is wound up by the conveyance roller 46 and is conveyed further downstream.

The positional relationship between the workpiece 44 being conveyed and the conveyance roller 46 is detected by a sensor 48 provided downstream of the conveyance roller 46, and the drive motor 38*m* intermittently rotates the large diameter pulley 26*b*, based on a detection result of the sensor 48. That is, a rotation of the endless belts 32*a* to 32*d* stops immediately after a leading edge of the workpiece 44 has passed through the conveyance roller 46 and resumes immediately after a trail edge of the workpiece 44 has been departed from the conveyance roller 46. As a result, on the average, a peripheral velocity of the large diameter pulley 26*b*, by extension, the endless belts 32*a* to 32*d*, is less than a peripheral velocity of the conveyance roller 46.

In a state where the workpieces 44, 44, . . . are stacked on the table 12, there may be a case that the second workpiece 44 is attached to the first workpiece 44 by a static electricity, for example, and the two workpieces 44 and 44 are multi-fed. However, although the first workpiece 44 reaches the downstream end of the first opening portion OP1 and is further conveyed downstream on the upper surface 14*tp* of the guide member 14, the second workpiece 44 adheres to the guide member 14 by the suction force generated in the second opening portion OP2.

The second workpiece 44 adhering to the guide member 14 adheres to the bottom surface of the belt drive mechanism 16 at a timing for canceling the multi-feed with the first workpiece 44, and is conveyed downstream by the endless belts 32*a* to 32*d*. Therefore, the workpiece 44 is supplied to the conveyance roller 46 one by one even if the two workpieces 44 and 44 are overlapped and conveyed out from the table 12.

As understood from the above-described description, the sheet-form workpieces 44, 44, . . . are mounted in a stacked state on the table 12. The guide member 14 has the upper surface 14*tp* assisting conveyance of the workpiece 44 and is arranged downstream of the table 12 in the workpiece conveyance direction. The belt drive mechanism 16 has the large diameter pulleys 26*a* to 26*d* and the small diameter pulleys 28*a* and 28*b* each extending in the direction orthogonal both to the workpiece conveyance direction and the up-and-down direction, and the endless belts 32*a* to 32*d* wound around these pulleys, and is arranged above the table 12 and the guide member 14 so as to stride over the table 12 and the guide member 14. The first opening portion OP1 is formed on the bottom portion of the belt drive mechanism 16 to generate the upward suction force. The second opening portion OP2 is formed on the upper surface 14*tp* of the guide member 14 to generate the downward suction force. Here, the magnitude of the suction force generated in the first opening portion OP1 exceeds the magnitude of the suction force generated in the second opening portion OP2.

Again, the workpiece 44 mounted on the table 12 adheres to the bottom portion of the belt drive mechanism 16 at the upstream end of the first opening portion OP1 and is conveyed downstream by the endless belts 32*a* to 32*d*. When the adhering workpiece 44 reaches the downstream end of the first opening portion OP1, the workpiece 44 departs from the belt drive mechanism 16 and is further conveyed downstream along the upper surface 14*tp* of the guide member 14.

If the two workpieces 44 and 44 are multi-fed, the first workpiece 44 reaches the downstream end of the first opening portion OP1, and is further conveyed downstream on the upper surface 14*tp* of the guide member 14. On the other hand, the second workpiece 44 adheres to the guide member 14 by the suction force generated in the second opening portion OP2.

The second workpiece 44 adhering to the guide member 14 adheres to the bottom portion of the belt drive mechanism 16 at a timing for canceling the multi-feed with the first workpiece 44, and is conveyed downstream by the endless belts 32*a* to 32*d*. As a result, it is possible to convey the workpiece 44 one by one without receiving assistance from an operator during operation.

Furthermore, the downstream end of the first opening portion OP1 is arranged downstream of the downstream end of the second opening portion OP2. As a result, it is possible to ensure that the second multi-fed workpiece 44 adheres to the guide member 14.

Furthermore, in view of the second multi-fed workpiece 44 being adhered to the guide member 14 at a position displaced toward the downstream, the distance from the downstream end of the second opening portion OP2 to the upstream end of the first opening portion OP1 is set to be shorter than the length from the leading end to the tailing end of the workpiece 44. As a result, it is possible to alleviate a concern that the third workpiece 44 adheres to the endless belts 32*a* to 32*d* in a state where the second workpiece 44 adheres to the guide member 14.

It is noted that in the present embodiment, although the first opening portion OP1 is formed on the bottom surface of the bottom-side case member 34*btm*, it may be possible that the case 34 is omitted and the endless belts 32*a* to 32*d* is replaced by a single endless belt having a countless number of through holes.

REFERENCE SIGNS LIST

10 . . . Workpiece conveying apparatus
12 . . . Table
14 . . . Guide member
16 . . . Belt drive mechanism
26*a* to 26*d* . . . Large diameter pulley
28*a*, 28*b* . . . Small diameter pulley
32*a* to 32*d* . . . Endless belt
38*m* . . . Drive motor
44 . . . Workpiece
46 . . . Conveyance roller
OP1 . . . First opening portion
OP2 . . . Second opening portion

The invention claimed is:

1. A workpiece conveying apparatus, comprising:

a table on which sheet-form workpieces are mounted in a stacked state;

a guide member which has an upper surface assisting a conveyance of said workpieces and which is arranged downstream of said table in a workpiece conveyance direction; and a belt drive mechanism which has a plurality of pulleys each extending in a direction orthogonal to both said workpiece conveyance direction and an up-and-down direction and an endless belt wound around said plurality of pulleys, and which is arranged above said table and said guide member so as to stride over said table and said guide member, wherein a first opening portion is formed on a bottom portion of said belt drive mechanism, and a second opening portion is formed on the upper surface of said guide member, the workpiece conveying apparatus further comprises a blower mechanism which generates an upward first suction force in said first opening portion and generates a downward second suction force in said second opening portion, wherein a magnitude of said first suction force exceeds a magnitude of said second suction force, the upper surface of said guide member is provided with a suppressing portion which suppresses positional displacement of the workpiece adhered to the upper surface by said second suction force, and a downstream end of said second opening portion is arranged upstream of a downstream end of said first opening portion.

2. The workpiece conveying apparatus according to claim 1, wherein a distance from the downstream end of said second opening portion to an upstream end of said first opening portion is shorter than a length from a leading end of said workpiece to a tailing end thereof.

3. The workpiece conveying apparatus according to claim 1, wherein said belt drive mechanism further comprises a motor which rotates said plurality of pulleys at a peripheral velocity lower than a peripheral velocity of a conveyance roller arranged downstream of said guide member.

4. The workpiece conveying apparatus according to claim 3, wherein said motor intermittently rotates said plurality of pulleys, based on a positional relationship between a workpiece conveyed by said belt drive mechanism and said conveyance roller.

5. The workpiece conveying apparatus according to claim 1, wherein said suppressing portion includes a friction material allocated at the periphery of said second opening portion out of the upper surface.

6. A workpiece conveying apparatus, comprising:

a table on which sheet-form workpieces are mounted in a stacked state;

a guide member which has an upper surface assisting a conveyance of said workpieces and which is arranged downstream of said table in a workpiece conveyance direction; and a belt drive mechanism which has a plurality of pulleys each extending in a direction orthogonal to both said workpiece conveyance direction and an up-and-down direction and an endless belt wound around said plurality of pulleys, and which is arranged above said table and said guide member so as to stride over said table and said guide member, wherein a first opening portion is formed on a bottom portion of said belt drive mechanism, and a second opening portion is formed on the upper surface of said guide member, the workpiece conveying apparatus further comprises a blower mechanism which generates an upward first suction force in said first opening portion and generates a downward second suction force in said second opening portion, wherein a magnitude of said first suction force exceeds a magnitude of said second suction force, the upper surface of said guide member is provided with a suppressing portion which suppresses positional displacement of the workpiece adhered to the upper surface by said second suction force, and said suppressing portion includes a first friction material and a second friction material which sandwich said second opening portion and each extends in said workpiece conveyance direction.

* * * * *